US006755278B2

(12) United States Patent
Huhn et al.

(10) Patent No.: US 6,755,278 B2
(45) Date of Patent: Jun. 29, 2004

(54) EMPLOYMENT OF SOUND DAMPERS IN HOUSEHOLD APPLIANCES AND ELECTRICAL APPLIANCES WITH SOUND DAMPERS

(75) Inventors: Theø Huhn, Bad Soden-Salmuenster Husen (DE); Udo Gaertner, Sinntal-Sannerz (DE)

(73) Assignee: Elaplast Technik GmbH, Bad Soden-Salmuenster (DE)

( * ) Notice: Subject to any disclaimer, the term of this patent is extended or adjusted under 35 U.S.C. 154(b) by 0 days.

(21) Appl. No.: 10/314,523

(22) Filed: Dec. 9, 2002

(65) Prior Publication Data

US 2003/0116377 A1 Jun. 26, 2003

(30) Foreign Application Priority Data

Dec. 10, 2001 (DE) ..... 101 60 465

(51) Int. Cl.[7] ..... H02K 5/24

(52) U.S. Cl. ..... 181/202

(58) Field of Search ..... 181/202, 198, 181/200, 231, 232, 238, 249, 208, 211, 217

(56) References Cited

U.S. PATENT DOCUMENTS 4,786,299 A * 11/1988 DeMarco ..... 96/382
4,938,309 A * 7/1990 Emdy ..... 181/231
5,979,598 A 11/1999 Wolf et al.

FOREIGN PATENT DOCUMENTS

DE 44 08 278 9/1995

* cited by examiner

*Primary Examiner*—Kimberly Lockett
(74) *Attorney, Agent, or Firm*—Schiff Hardin LLP

(57) ABSTRACT

To dampen a sound created in an electrical tool or appliance having an air passage through which air is being forced, a sound damper is placed in the air passage. Preferably, a filter is provided upstream of the sound damper to prevent suspended particles, fibers, fumes and the like from entering the sound damper.

14 Claims, 3 Drawing Sheets

Fig 1
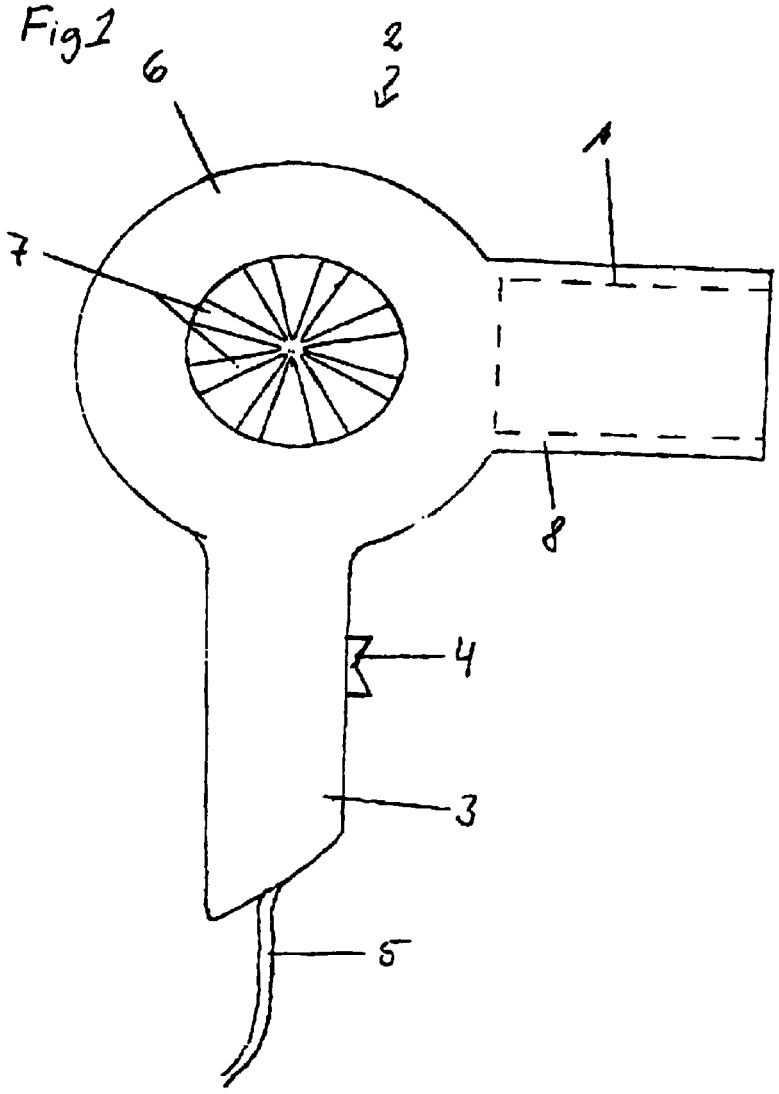
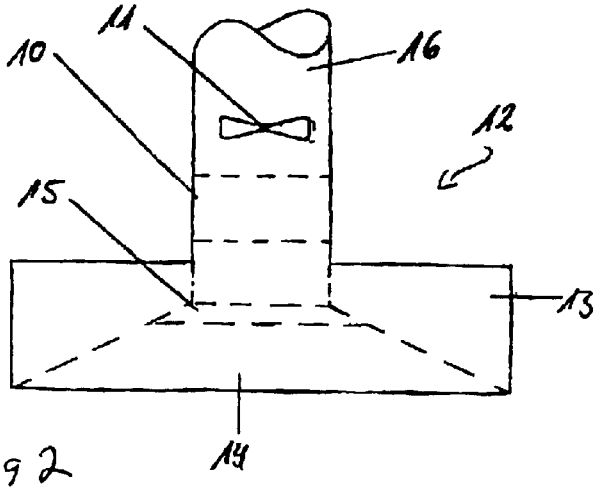
Fig 2

Fig 3
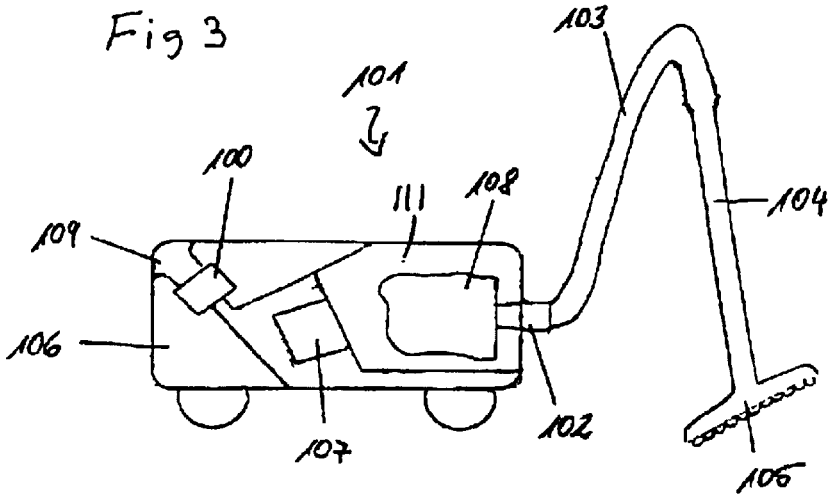
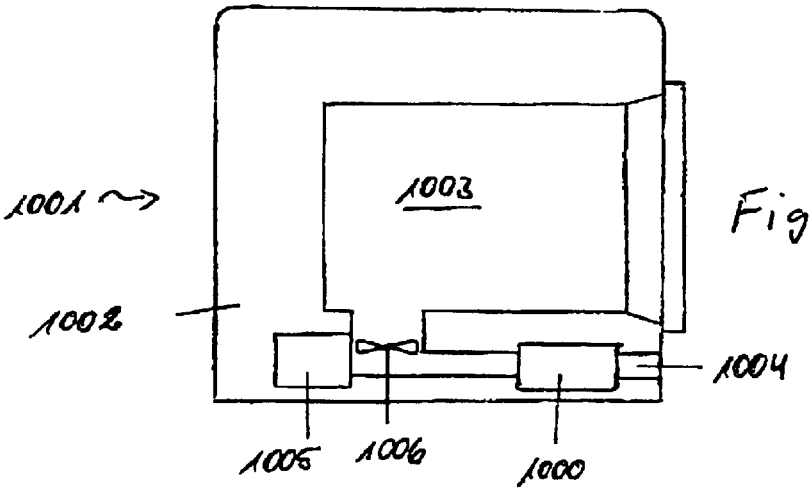
Fig. 4

EMPLOYMENT OF SOUND DAMPERS IN HOUSEHOLD APPLIANCES AND ELECTRICAL APPLIANCES WITH SOUND DAMPERS

BACKGROUND OF THE INVENTION

The present invention is directed to a method of employing a sound damper for noise reduction in tools and household appliances and to electrical appliances with sound dampers.

Efforts are made in daily life to avoid an excessive creation of noise due to the negative effects thereof on the human condition, for example as a cause of stress. High noise intensities are thereby caused, among other things, by devices or machines that work with the circulation of a gas, such as air.

U.S. Pat. No. 5,979,598, whose disclosure is incorporated herein by reference thereto and which claims priority from German 196 15 917, discloses an intake sound damper for an internal combustion engine that is fashioned as a broadband airborne noise absorber for the intake noises that are impressed on the combustion air taken in by internal combustion engines. In order to achieve the broadband effect, an axial sequence of resonator chambers with volumes that respectively differ from one another is formed in a resonator surrounding an intake pipe, and these resonator chambers are formed by partitions fashioned transverse to the axis of the intake pipe. Each of these resonator chambers is in communication with the intake air guided in the intake pipe via wall openings that are formed in the wall of the intake pipe. By matching the aperture area of the openings, the wall thickness of the intake pipe in the region of the openings and the volume of the resonator chambers, a continuous broadband damping can be set over a great frequency range, in the range, for example, from 1–10 kHz that is of practical interest here. In motor vehicles having an internal combustion engine with a supercharger and a charge cooling, the known intake sound damper is advantageously arranged immediately behind or at or integrated in the pressure joint of the supercharger at a distance preceding the charge cooling in any case.

SUMMARY OF THE INVENTION

The object of the present invention is to also enable a noise reduction given tools and/or household appliances operated with electrical motors as compared to internal combustion engines.

This object is achieved by a method of providing a tool or household appliance that is not powered by internal combustion, but is powered by an electrical motor and has an air passage selected from an air intake, an air- or gas-cooled passage or a gas or air exhaust or outlet; and providing a sound damper for noise reduction in the air passage.

It is thereby preferred that the tool and/or household appliance is an electrical appliance, such as a hair dryer, a hair dryer hood, a fume extraction hood, a vacuum cleaner, an exhaust air or, respectively, condensate or clothes dryer, a leaf vacuum, a leaf blower or a hand dryer.

It is also inventively proposed that the sound damper is preceded by at least one filter element that essentially prevents suspended particles, dust and/or fibers from proceeding into the inside of the sound damper.

In addition, an electrical appliance is inventively offered that has an air or gas passage selected from gas-intaking, gas-cooled and gas-expelling and has a sound damper disposed in the passage.

An inventive electrical appliance is thereby particularly characterized in that the sound damper is composed of an intake pipe carrying the intake air and of a resonator housing surrounding this upon formation of a closed annular space comprising an admission connector and a discharge connector as well as openings in the pipe wall of the intake pipe that are connected to the interior of the resonator. The sound damper comprises an axial sequence of a plurality of chamber walls in the resonator extending transverse relative to the longitudinal axis of the intake pipe and surrounding the intake pipe. The chamber walls form resonator chambers of different volumes in the resonator housing that are hermetically delimited relative to one another, and by such an arrangement of the openings in the pipe wall of the intake pipe that each of the resonator chambers communicates with the interior of the intake pipe and none of the chamber walls are thereby bridged.

An electrical appliance is also inventively characterized by openings in the pipe wall of the intake pipe, all of said openings having the same geometrical shape.

The inventive electrical appliance is also characterized by openings in the pipe wall of the intake pipe that all have a circular-cylindrical shape and that all comprise the same diameter.

Moreover, an inventive electrical appliance is characterized by such an arrangement of the openings in the pipe wall of the intake pipe that each of the resonator chambers communicates with the interior of the intake pipe via the same number of openings.

Preferably, an inventive electrical appliance is characterized by such an arrangement of the openings in the pipe wall of the intake pipe that the openings allocated to each of the resonator chambers comprise the same geometric distribution of the intake pipe wall.

Moreover, an inventive electrical appliance is characterized by an oval or flattened oval cross-section of the intake pipe.

Over and above this, an inventive electrical appliance is characterized by a wall section fashioned without openings continuously from the intake connector to the discharge connector, said wall section being in a valley region of the intake pipe with reference to the use-conforming installed position of the intake pipe in the sound damper and of the sound damper in or, respectively, at the electrical appliance.

An inventive electrical appliance is also characterized by a two-shell fashioning of the intake pipe with an axial parting plane. Alternatively, an inventive electrical appliance is characterized by a two-shell fashioning of the resonator housing with an axial parting plane.

Advantageously, an inventive electrical appliance is characterized by the fashioning of the intake pipe as an insert in the resonator housing.

Moreover, an inventive electrical appliance is characterized by admission connectors and discharge connectors applied at the resonator housing.

Finally, an inventive electrical appliance is characterized by an axial sequence of resonator chambers with chamber volumes either steadily decreasing or steadily increasing in a flow direction.

The invention is, thus, based on the perception that the employment of a sound damper fundamentally known for internal combustion engines in tools and household appliances that are operated with alternative electrical energy sources, preferably electrical motors, leads to a considerable minimization of the noise intensity emitted during their operation.

Other advantages and features of the invention will be readily apparent from the following description, the claims and drawings.

BRIEF DESCRIPTION OF THE DRAWINGS

FIG. 1 is a side view of a hair dryer with a built-in sound damper in accordance with the present invention;

FIG. 2 is a cross-sectional view through a fume extraction hood with a built-in sound damper in accordance with the present invention;

FIG. 3 is a partial cross-sectional view of a vacuum cleaner with an installed sound damper in accordance with the present invention;

FIG. 4 is a cross-sectional view of a clothes dryer with a built-in sound damper in accordance with the present invention.

DESCRIPTION OF THE PREFERRED EMBODIMENTS

Figure 5:
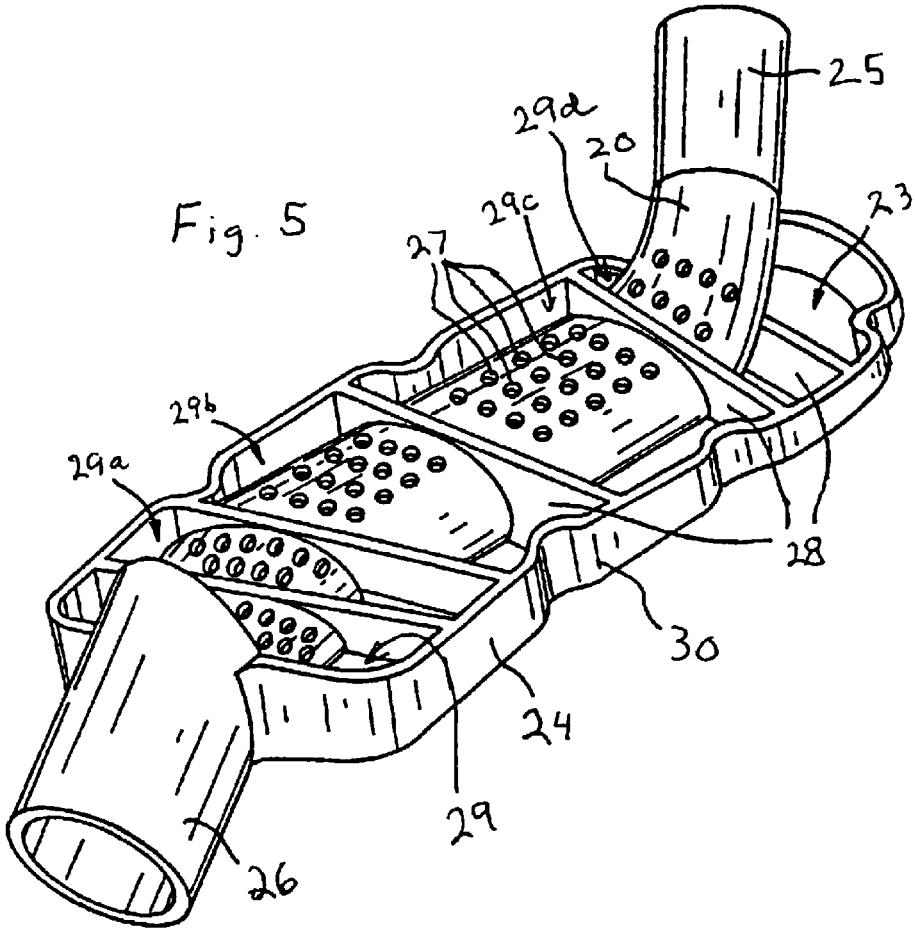
FIG. 5 is a perspective illustrative embodiment of a sound damper being utilized in the present invention with the cover removed from the resonator housing.

The principles of the present invention are particularly useful when incorporated into a sound damper 1, which is illustrated as being installed in a nozzle 8 of a hair dryer, generally indicated at 2. The hair dryer 2 has a handle 3 with a switch 4 arranged in the handle for turning electrical power, which is supplied by a power cord 5, on and off. The hair dryer has a main housing 6, which is connected to the handle and has intake slots 7 for air to be drawn into the housing by an exhauster or electrical fan (not illustrated) and discharged through the nozzle 8 after being heated by electrical heating elements (not illustrated) for heating the intake air. The sound damper 1 is arranged in the nozzle so that, preferably, all of the expelled air must pass through the sound damper to have a reduction in the noise level.

A fume extraction hood, generally indicated at 12, is shown in FIG. 2 and employs a sound damper 10 as a noise-reducing element. The extraction hood 12 has a housing 13 that contains a funnel-shaped exhaust opening 14 that extends into an air passage, such as an exhaust shaft 16. To draw the fume-containing cooking atmosphere into the funnel-shaped exhaust opening 14, an exhaust fan having a blade 11 is disposed in the exhaust shaft 16. To remove dirt and fluid that may be contained in the cooking atmosphere, a filter or a condensate separator 15 is disposed in the funnel-shaped exhaust opening 14 and, to reduce the noise level, the sound damper 10 is disposed in the exhaust shaft 16 in a position so that it receives the exhausted gas after it is passed through the separator or filter 15. As illustrated, the damper 10 is positioned between the fan blade 11 and the filter; however, it could be positioned downstream of the exhaust fan blade 11.

The inventive sound damper can be used for minimizing noise in a vacuum cleaner, generally indicated at 101. As illustrated, the vacuum cleaner 101 is a tank-type cleaner having a housing 106 which has a chamber 111 in which a bag 108 is received. The bag 108 is connected by an intake connector 102 to a hose 103 that extends to a vacuum cleaner pipe 104 that terminates at a vacuum appliance, such as a brush head 105. An electrical motor 107 drives an exhaust fan which creates a vacuum to draw air and dirt in through the brush head 105 through the tube 104, the hose 103, the connector 102 into the bag 110 disposed in the chamber 111. The air drawn out of the chamber 111 is discharged through a discharge opening 109, which receives a sound damper 100 of the present invention to reduce the noise level.

Another electrical appliance which can use a sound damper, such as 1000 in accordance with the present invention, is a clothes dryer, generally indicated at 1001, that has a laundry drum 1003, which receives laundry to be dried and is mounted in a housing 1002 of the dryer 1001. An air intake passage 1004, which is positioned under the laundry drum 1003, allows ambient air to be conducted into the laundry drum 1003 by a fan blade or exhauster 1006 driven by a motor 1005. The sound damper 1000 is arranged between an opening of the intake passage 1004 and the exhauster or fan blade 1006 to reduce noise.

Each of the sound dampers 1, 10, 100 and 1000 can comprise the structure which is disclosed in the above-mentioned U.S. Pat. No. 5,979,598. As illustrated in FIG. 5, a sound damper disclosed in this patent comprises an intake pipe 20 carrying the intake air and of a two-pan resonator housing 24, which has one pan 30 illustrated. The housing 24 surrounds the pipe 20 and forms a closed annular space 23. In addition, the damper includes an intake connector 25 and a discharge connector 26, as well as openings 27 in the pipe wall of the intake pipe 20. The openings 27 connect the inside of the intake pipe to the inside of the resonator, which has an axial sequence of a plurality of chamber walls 28 directed transverse relative to the longitudinal axis of the intake pipe 20 and surrounding the intake pipe to sub-divide the annular space into a plurality of resonator chambers 29, 29*a*, 29*b*, 29*c* and 29*d*. As illustrated, volumes of the resonator chambers 29–29*d* are different with the chamber 29 having the smallest volume and the chamber 29*d* having the highest volume. These resonator chambers 29–29*d* are hermetically delimited relative to one another and, due to the arrangement of the openings 27 in the pipe wall of the intake pipe 20, each of the resonator chambers 29–29*d* communicates with the interior of the intake pipe 20 and none of the chamber walls 28 are thereby bridged.

While the pipe 20 is shown as a one-piece member, it can be formed of two half-pipes, which are sealed together. In addition, the resonator housing 24, as shown in FIG. 5, has only the one pan 30, while there is an additional pan or lid which has a structure of walls which are matched to the chamber walls 28 and which coact with the walls 28 to form the enclosed resonator chambers 29–29*d*.

The employments that have been cited partly show that the sound damper is preferably installed following a filter element in a tool or household appliance. The filter element essentially isolates dust, suspended particles, fiber, fumes and/or the like from the sound damper in order to prevent a potential blockage of the openings arranged in the sound damper.

Although various minor modifications may be suggested by those versed in the art, it should be understood that we wish to embody within the scope of the patent granted hereon all such modifications as reasonably and properly come within the scope of our contribution to the art.

We claim:

1. An electrical appliance comprising an air passage, electrical means for creating a flow of air through said passage, and a sound damper disposed in the passage for reducing the noise level, the sound damper being composed of an intake pipe carrying an intake air and of a resonator housing surrounding the intake pipe and forming a closed annular space, an admission connector and a discharge connector being in communication with the intake pipe, the resonator housing including a plurality of chamber walls extending transverse to a longitudinal axis of the intake pipe and surrounding said intake pipe to form a plurality of resonator chambers having different volumes in the resonator housing, said chamber walls hermetically limiting each of the chambers relative to one another, said intake pipe having openings in communication with the resonator chambers so that the intake pipe is in communication with each of the resonator chambers and none of the chamber walls are bridged.

2. An electrical appliance according to claim 1, wherein the openings in the pipe wall of the intake pipe have the same geometrical shape.

3. An electrical appliance according to claim 1, wherein the openings in the pipe wall of the intake pipe have a circular-cylindrical shape and have the same diameter.

4. An electrical appliance according to claim 1, wherein the arrangement of the openings in the pipe wall of the intake pipe of each resonator chamber communicate with the interior of the intake pipe via the same number of openings.

5. An electrical appliance according to claim 1, wherein an arrangement of the openings in the pipe wall of the intake pipe is such that the openings allocated to each resonator chamber comprise the same geometrical distribution on the intake pipe wall.

6. An electrical appliance according to claim 1, wherein the intake pipe has a shape selected from an oval or flattened oval cross-section.

7. An electrical appliance according to claim 1, wherein a wall sector fashioned without openings extends continuously from the intake connector to the discharge connector, said wall sector being in a lower region of the intake pipe with reference to the use-conforming installed position of the intake pipe in the sound damper and the position of the damper in the electrical appliance.

8. An electrical appliance according to claim 1, wherein the intake pipe is formed by two-shells having a parting plane.

9. An electrical appliance according to claim 1, wherein the resonator housing is fashioned of two pans having a parting plane.

10. An electrical appliance according to claim 1, wherein the intake pipe is an insert in the resonator housing.

11. An electrical appliance according to claim 10, wherein the resonator housing includes an emission connector and a discharge connector in communication with the intake pipe.

12. An electrical appliance according to claim 1, wherein the resonator chambers are arranged in an axial sequence with the chamber volumes steadily changing with regard to a flow direction through the intake pipe.

13. An electrical appliance according to claim 1, wherein the appliance is selected from a group consisting of a hair dryer, a hair dryer hood, a fume extraction hood, a vacuum cleaner, a clothes dryer, a leaf vacuum, a leaf blower and a hand dryer.

14. An electrical appliance according to claim 1, which includes at least one filter element being provided upstream of the sound damper to prevent suspended particles, dust and fibers from proceeding into the sound damper.

* * * * *